United States Patent [19]

Ulbing et al.

[11] 4,105,882

[45] Aug. 8, 1978

[54] CONTROL STATION SWITCH

[75] Inventors: Otmar M. Ulbing, Webster; Edmund R. Koval, Tonawanda, both of N.Y.

[73] Assignee: Columbus McKinnon Corporation, Tonawanda, N.Y.

[21] Appl. No.: 773,975

[22] Filed: Mar. 3, 1977

[51] Int. Cl.[2] ..... H01H 21/10

[52] U.S. Cl. ..... 200/157; 200/1 V; 200/242

[58] Field of Search ..... 200/1 V, 1 A, 1 TK, 200/6 R, 6 AB, 238, 239, 241, 242, 244, 245, 246, 67 G, 157, 164 R, 165, 298, 153 R

[56] References Cited

U.S. PATENT DOCUMENTS

| | | | |
|---|---|---|---|
| 2,659,838 | 11/1953 | Du Rocher | 200/153 R X |
| 2,716,682 | 8/1955 | Franklin | 200/164 R X |
| 3,288,947 | 11/1966 | Wanlass et al. | 200/6 R |
| 3,408,463 | 10/1968 | Wanlass | 200/6 R |
| 3,654,415 | 4/1972 | Hawkins et al. | 200/157 X |

*Primary Examiner*—Philip R. Coe

[57] ABSTRACT

A pressure actuated reversing switch for a pendant hoist control station is provided in which manually exerted pressure causes the electrical contacts to make and break in a staggered sequence. The armature of the switch is spring loaded so that pressure exerted on the armature causes the armature to move both laterally and rotationally. This complex motion permits contacts at one end of the armature to be brought into electrical contact with the leads prior to power contact being made at the other end of the armature. When pressure is released, the complex motion permits the power contacts to be broken prior to the breaking of the contacts at the other end of the armature. Additionally, the complex motion permits a self-cleaning action which assures reliability and long life.

23 Claims, 10 Drawing Figures

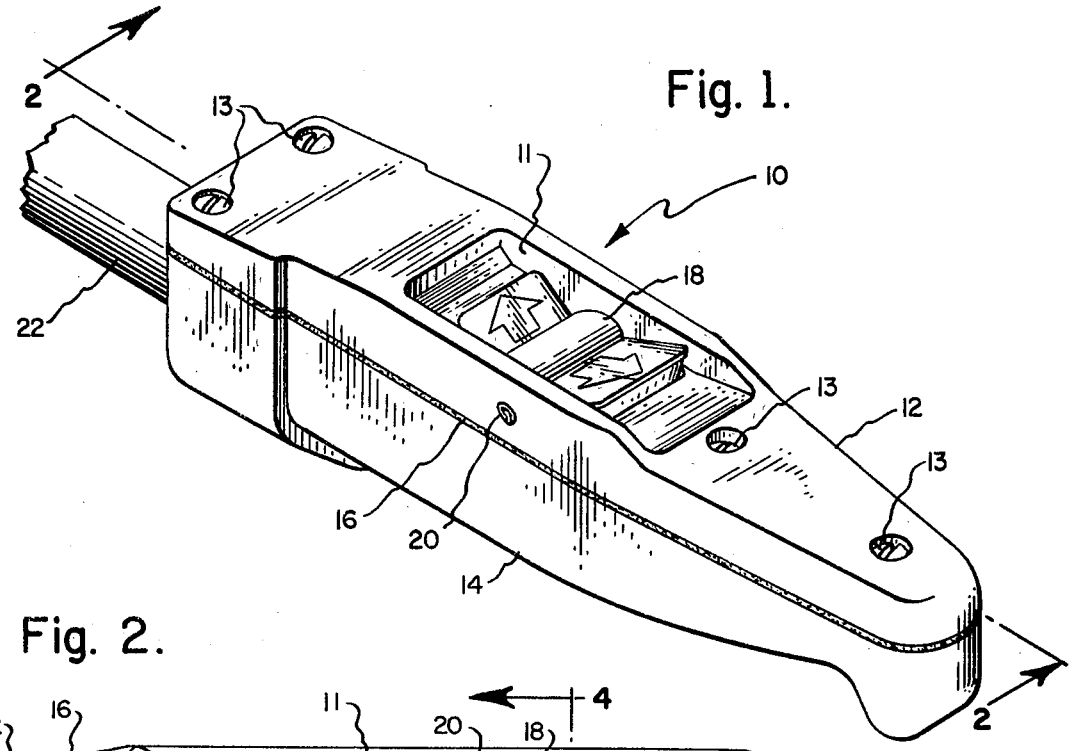
Fig. 1.
Fig. 2.
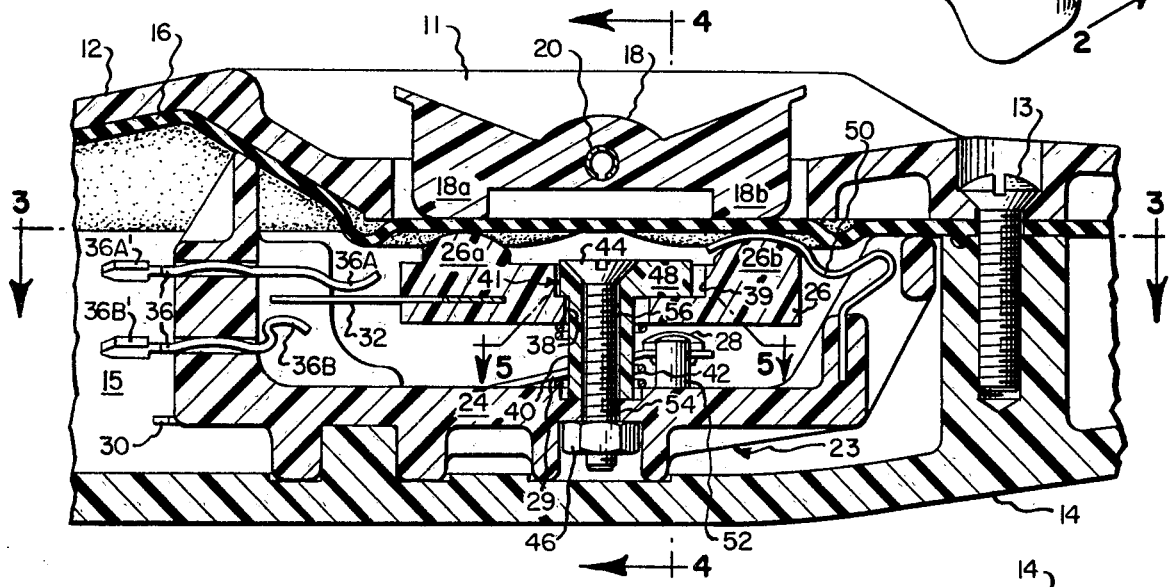
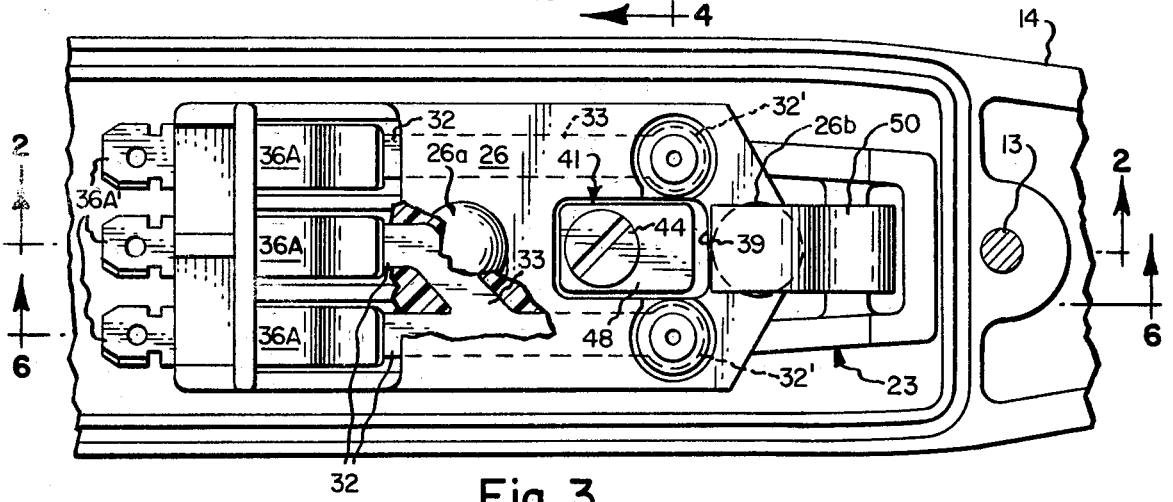
Fig. 3.

CONTROL STATION SWITCH

BACKGROUND OF THE INVENTION

This invention relates generally to switches or relays and in particular to pressure actuated relays in which electrical switch contacts are caused to make and break in sequence in response to manually exerted pressure. More particularly, this invention relates to a pendant switching station provided for the operation of a hoist or the like.

There are innumerable industrial applications in which it is desirable to apply power simultaneously to two or more industrial components. A typical application is found in an electric hoist in which it is essential to apply electrical power to one or more coils of a hoist motor and at the same time to a coil that electrically actuates release of the brake. Accordingly, multiple contact switches have been developed to provide the application of power to a plurality of industrial components. One such switch is disclosed in U.S. Pat. No. 3,087,031. A difficulty with achieving switching simultaneity arises with switches of this kind and with switches of other prior art devices, however, as it is difficult to assure that the plurality of contacts all make and break at the same moment. The difficulty is aggravated by the fact that the make and break contacts tend to erode at different rates and may accumulate non-uniform deposits of dirt or other foreign matter. As a result, the plurality of electrical contacts not only exhibit different electrical resistances and therefore pass electrical currents of different magnitudes, but also may close their respective circuits at non-simultaneous moments.

It is well known that the erosion of electrical contacts and the problems caused by dirt accumulation can be minimized by the use of exotic and expensive rare earth alloys at the contacts rather than less expensive base metal alloys. As is readily apparent however, switches which have multiple contacts for the application of power to a plurality of devices can be rather expensive when each of the contacts include these rare earth alloys. In fact, the cost of the alloy contacts alone can be a major contribution to the overall cost of the multiple contact switch. It is also well known that electrical contacts passing larger power currents sometimes tend to "weld" together making it difficult, if not impossible, to break the circuit. This is obviously undesirable since a malfunctioning switch operating a device such as a hoist could cause a serious industrial accident if the hoist could not be turned off at the appropriate moment in either its lift or lower modes. These and other difficulties have created a need for an inexpensive, reliable, multi-contact switch which has a positive means for breaking the circuit.

SUMMARY OF THE INVENTION

The present invention avoids these and other difficulties by providing a multiple contact switch design which dispenses with the necessity of providing many expensive alloy contacts; which insures that electrical contact is made to close the functional circuits before any power is applied; which creates a rolling and sliding action as the contacts are brought together so that self-cleaning of the contacts accompanies contact making and breaking; which continually assures self-alignment of the contacts by wearing in the contact surfaces during use; and which prevents high heat concentration at the contacts so that pitting and arcing is minimized. The present invention also provides a switch which is compact, requires no mounting hardware in a pendant pistol grip switch unit and has a minimum number of moving parts with accompanying high reliability. The switch herein disclosed also guarantees that the electrical circuit can be opened by applying an extra pressure to the switch actuating mechanism.

The pressure actuated hoist control switch of the invention comprises a base having first and second electrical contacts longitudinally spaced from one another and electrically insulated from one another. Positioned above the base is an armature having its own first and second electrical armature contacts longitudinally spaced from one another and connected by an electrical conductor. The armature is mounted above the base by a resilient mounting means with the first and second electrical armature contacts adjacent to the first and second electrical base contacts respectively. The resilient mounting means permits rotational rocking movement of the armature about a plurality of axes transverse to the longitudinal axis of the armature.

The contacts at one end of the base and the corresponding one end of the armature may be a multiplicity of contacts provided for the simultaneous closing of plural electrical circuits. These contacts are hereafter called the passive contacts since they are caused to make and break in the absence of electrical current. The contacts at the other ends of the base and armature are the power contacts since they make after and break before the passive contacts, thereby applying power to and disconnecting power from the plural electrical circuits. The power contacts may also be provided in multiples to divide the load between them or to make possible the supply of powers of different magnitudes to the different passive contacts and hence to the different circuits served by the switch.

The passive contacts of the base include first and second vertically spaced horizontally offset contacts having convex mutually facing surfaces. The corresponding passive contacts of the armature have upper and lower contact surfaces and are mounted in a neutral position between the first and second vertically spaced passive contacts of the base.

The resilient mounting means includes a spring mounted between the armature and the base and a switch stand means for limiting motion of the armature away from the base. The spring and the switch stand motion limiting means permit rotational movement of the armature as well as a limited longitudinal movement. The spring acts as a resilient fulcrum about which the armature may rotate in either direction. With this construction pressure exerted on one end of the armature toward the base causes the armature to rotate around the resilient fulcrum provided by the spring until the passive contacts of the base and the armature achieve electrical contact at a point. Thereafter, continued pressure on the same end of the armature rotates the armature around the point of contact of the passive contacts, depressing the fulcrum-spring, until the power contacts at the other end of the base and the armature are closed and power is applied to the circuit. Removal of the pressure from the flexibly mounted armature causes a reversal of these movements so that the power contacts are broken prior to the separation of the passive contacts. This staggered make and break operation permits the passive contacts to be constructed of inexpensive base metal alloys. The only requirement for expensive rare earth metal alloys is at the power contacts which are last closed and first opened.

A stationary immovable fulcrum is provided on the base or on the armature so that a mechanical advantage can be brought to bear on the armature by an overload pressure in order to separate any contact which may have been inadverently welded together by passage of the current, or inductively induced high voltage and current spikes.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which;

FIG. 1 is a perspective view of a control switch formed in accordance with a preferred embodiment of the present invention;

FIG. 2 is a sectional view taken generally along the line 2—2 in FIG. 1;

FIG. 3 is a sectional view taken generally along the line 3—3 in FIG. 2;

DESCRIPTION OF THE PREFERRED EMBODIMENT

Figure 4:
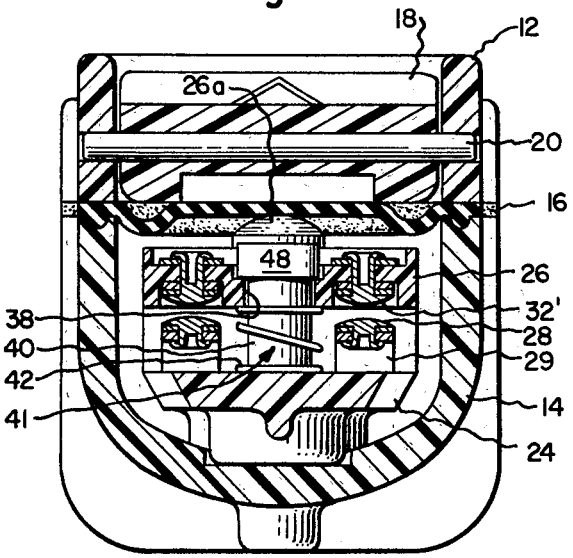
FIG. 4 is a sectional view taken generally along the line 4—4 in FIG. 2.
Figure 5:
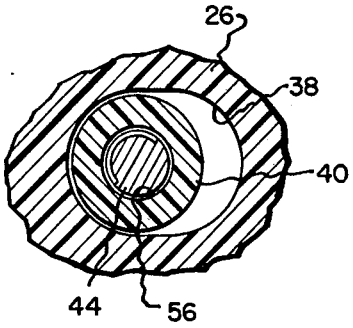
FIG. 5 is a sectional view taken generally along the line 5—5 of FIG. 2.

FIG. 1 shows generally a pendant hoist control station 10 which generally includes a casing having upper 12 and lower 14 halves. These casing halves are joined as by screw fasteners 13. The upper and lower halves 12 and 14 of the casing generally form a pistol-grip like configuration in order to facilitate the gripping of the unit by either hand of the user. Casing halves 12 and 14 are hollowed, such as to provide a cavity 15 in which the electric switch assembly 23 of the invention is housed. Casing half 12 is formed with an opening 11 therein to provide communication with the cavity 15. The switch assembly 23 is fluid sealed relative to opening 11 by a flexible diaphram 16, which is perferably clampingly secured in a sandwich relationship between casing halves 12 and 14. The general arrangement of this pendant hoist control unit is disclosed in U.S. Pat. No. 3,654,415 issued to Hawkins, Dick & Bongort on Apr. 4, 1972 and assigned to the assignee of the present invention. A rocker arm 18 is mounted on the casing half 12, as by a roll pin 20 which acts as a pivot shaft for the pivotal movement in opposite directions of the rocker arm 18.

The switch assembly 23 itself is shown as being captured between casing halves 12 and 14 in the cavity 15. Accordingly, the casing halves 12 and 14 are sculptured on their inner surfaces to provide a close fit for the switch assembly 23 and so that the switch assembly 23 may easily be dropped into the lower casing half 14 when the upper casing half 12 and the gasket 16 have been removed.

The switch assembly 23 is constructed of a base 24 and an armature member 26. As best seen in FIG. 2, the switch assembly 23 is positioned within the lower casing half 14 in such a manner as to locate the armature 26 immediately under the rocker arm 18 when the two halves 12 and 14 of the unit are assembled. Accordingly, one end of the rocker arm 18 overlies one end of armature 26 and the other end of the rocker arm 18 overlies the other end of the armature 26. With this configuration, pressure exerted on either end of the rocker arm 18 by the thumb of a human operator, causes the rocker arm 18 to rotate in either clockwise or counter-clockwise directions thereby transmitting pressure through the flexible gasket 16 to either of the raised portions 26*a* or 26*b* of the armature 26. As can be seen from the arrows appearing in FIG. 1, the switch unit 10 and the switch assembly 23 are arranged so that pressure applied on the left hand portion of rocker arm 18 would actuate the control of a hoist in the upper direction whereas pressure on the right hand side of rocker arm 18 would actuate the control of the hoist in the downward direction.

The base 24 of the switch assembly includes first and second electrical base contact means designated generally at 36 and at 28 longitudinally spaced from one another and electrically insulated from one another. The first electrical base contact means 36 consists of a plurality of first contacts 36A and a plurality of second contacts 36B which are laterally (or vertically) spaced from one another. These electrical base contacts 36 are the passive contacts and comprise a strip of base metal alloy held by the first end of the base 24. The externally directed ends 36A' and 36B' of the contact means 36 are adapted for connection to a control cable 22 which exits from the left hand end of the pendant hoist control station 10.

The contact ends 36A and 36B are so positioned as to meet the contact member 32 at spaced apart positions, at opposite sides thereof, so as to avoid high heat concentrations at any single point along the contact 32, thereby greatly increasing the life of the contacts.

At the other end or second end of the base 24, electrical contact or contacts 28 are mounted on the base 24 by means of a spring member 29. Spring member 29 is a brass conductor. Conductor 29 passes through and is held by the base 24 so that the one end of the spring member 29 is rigidly fastened to the base. The conductor terminates at end 30 which penetrates through the other side of the base 24. End 30 acts as a terminal for the connection of power leads to the switch. A fine silver composite contact 28 is mounted at the other end of the spring member 29. This rare earth metal contact is provided to minimize the tendency of the switch to power arc and of the contacts to become corroded and pitted. By mounting contact 28 on spring member 29, the contact 28 may be deflected in a circular arc when pressure is brought to bear on its upper surface. The ability of contact 28 to move tends to create a self-cleaning sliding or wiping motion between the upper surface of contact 28 and the element brought to bear against it.

As best seen in FIGS. 2 and 3, armature 26 is resiliently mounted adjacent to and laterally of the base 24. Armature 26 has a longitudinal axis lying generally parallel to the longitudinal axis of the base 24. Accordingly, the armature 26 has a first end carrying a first electrical contact 32 and a second end carrying a second electrical contact 32'. First electrical armature contact 32 and second electrical armature contact 32' are connected by an electrical conductor 33. Electrical armature contact 32, the armature passive contact, may consist of an inexpensive base metal alloy whereas electrical armature contact 32', the armature power contact, may consist of a rare earth metal alloy. The passive contact 32 which may be a multiplicity of passive contacts 32 are held in neutral positions adjacent to and intermediate the multiplicity of passive base contacts 36A and 36B. The armature power contact 32' is resiliently held in a neutral position adjacent to the base power contact 28. The resilient mounting means which positions the armature 26 adjacent to the base 24 (to be described hereinafter) permits the alternate movement of the armature passive contacts into touching relationship with either of the base passive contacts 36A or 36B. The resilient mounting means also permits the movement of the armature power contact 32' into touching relationship with the base power contact 28. Passive armature contact 32 is positioned midway between base contact 36A and 36B so that movement of the passive armature contact in either direction toward or away from the base 24 brings the armature contact 32 into electrical contact with either the base contact 36A or the base contact 36B.

FIG. 3 is a broken away top view of the armature 26 and illustrates the redundancy of the passive contacts and the power contacts. The electrical conductor 33 which connects the armature power contacts 32' with the passive contacts 32, may be divided into two or more branches as shown. Thus, the electrical conductor 33 originates at the armature power contact 32' and branches midway between the power contact 32' and the passive contact 32 into two adjacent branches. In this manner two of the adjacent passive contacts 32 as shown in FIG. 3 would carry the same power. If one of the industrial components to be serviced by this switch requires a power of a different voltage or current, this power may be brought into the remaining power contact 32' shown in phantom in FIG. 3 via the other base power contact 28. A straight electrical conductor 33 then connects the contact 32' (also shown in phantom) to the remaining passive contact 32. In this manner, one of the terminals 36A or 36B can be caused to be connected to a different power source.

Returning now to the embodiment shown in FIGS. 2 and 3, it can be seen that the top surface of armature 26 is provided with a rectangular recess 39. Extending downwardly from rectangular recess 39 is an ovular hole 38 communicating between the bottom surface of the armature and the rectangular recess 39. An L-shaped retainer or switch stand 41 fits into the rectangular recess 39 and penetrates through the ovular passage 38 with rectangular shoulder 48 occupying the rectangular recess 39 and with cylindrical shaft 40 passing through the ovular passage 38. The L-shaped retainer 41 is further provided with a cylindrical passage 56 therethrough coaxial with the axis of the shaft 40. The base 24 is in turn provided with a hole 54 which may be aligned with the cylindrical passage 56 of retainer 41. Screw 44 and nut 46 are shown holding the L-shaped retainer 41 firmly to the base 24. A spring 42 is concentrically positioned exterior to the shaft 40 for the purpose of resiliently pressing the armature 26 away from the base 24. Spring 42 biases the armature 26 laterally away from the base but shoulder 48 on the L-shaped retainer 41 limits the lateral movement of the armature 26 away from the base 24.

Figure 6:
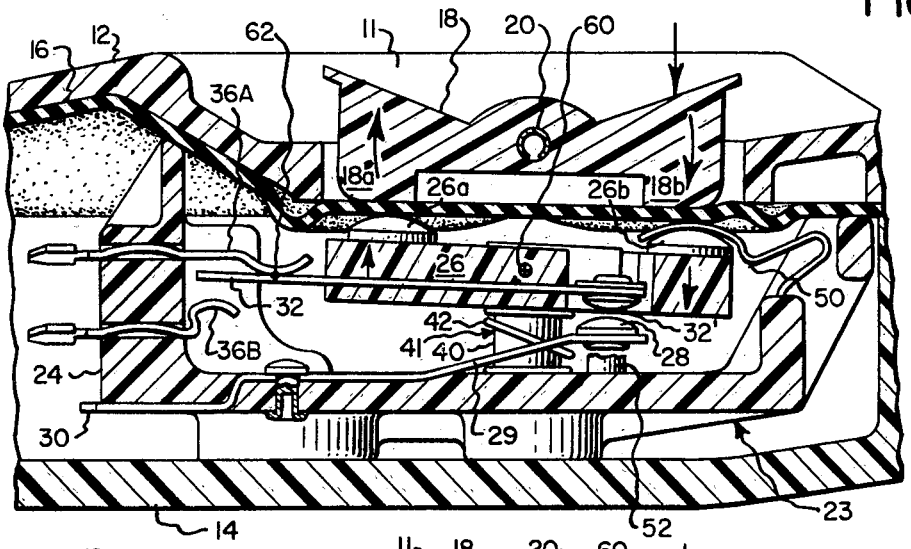
FIG. 6 is a sectional view taken generally along the line 6—6 of FIG. 3 illustrating one mode of operation.
Figure 7:
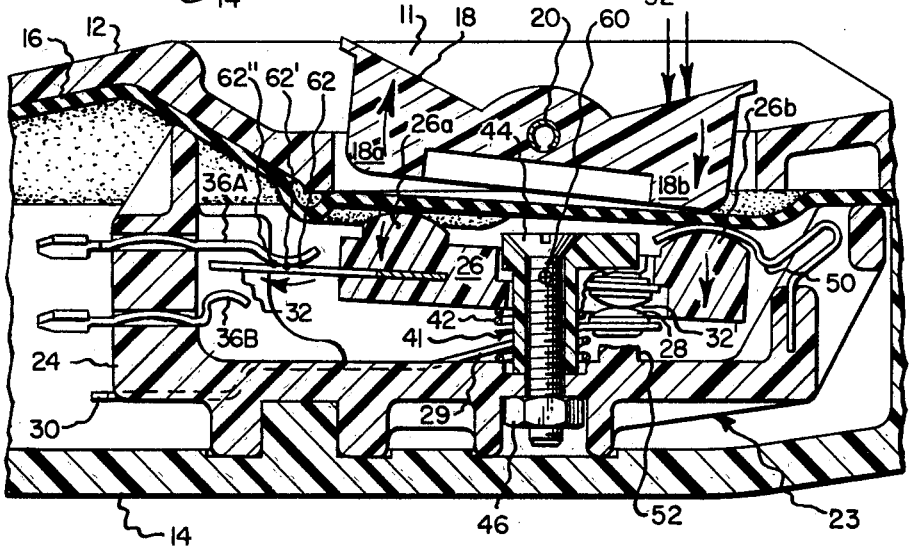
FIGS. 7, 8, 9 and 10 are sectional views similar to the sectional view of FIG. 2 and illustrate the various modes of operation of the switch of the present invention.

As can be seen from an examination of FIG. 2 and FIG. 6, the rectangular recess 39 has a longitudinal length longer than the rectangular shoulder 48. The ovular passage 38 is oriented with its major axis aligned with the longitudinal axis of armature 26. These two features, ie, the size of the rectangular recess 39 and the orientation of the ovular passage 38, permit the armature 26 to be rotated about an axis or axes transverse to the longitudinal axis of the switch assembly 23. Furthermore, the relative sizes of these elements permits a limited longitudinal movement of the armature but does not permit any appreciable degree of a transverse movement. As can further be seen from FIG. 2, the raised portion **26*b* has a curved surface. Immediately overlying this curved surface is a leaf spring 50 which is captured in the second end of the base 24 and which itself has a curvature. The spring 50 operates to somewhat increase the resistance against actuation of the rocker in the "down" direction; thereby equalizing the pressures required to shift the rocker in either direction. This gives the operator a uniform "feel" of the switch mechanism such as when operating the hoist in either direction. Also note, the degree of curvature of the portion of the leaf spring 50 which overlies the raised portion of 26*b* of the armature 26 is less than the degree of curvature of the upwardly facing surface of the raised portion 26*b*. The difference in curvatures between the leaf spring 50 and the raised portion 26*b* of the armature 26 assists in causing the armature 26 to undergo a limited longitudianl movement when the leaf spring 50 is depressed by pressure exerted on the rocker arm 18. Thus, when the leaf spring 50 is forced into engagement with the raised portion 26*b*, the interaction of the surfaces tends to draw the armature 26 to the right. Alternatively, another possible arrangement which would produce the longitudinal movement of the armature 26 would be if the downwardly facing surfaces of rocker arm portions 18*a* and 18*b* were angled such that the pressure transmitted by the rocker arm 18 was applied to the armature 26** in a direction having an angle with the vertical.

Figure 9:
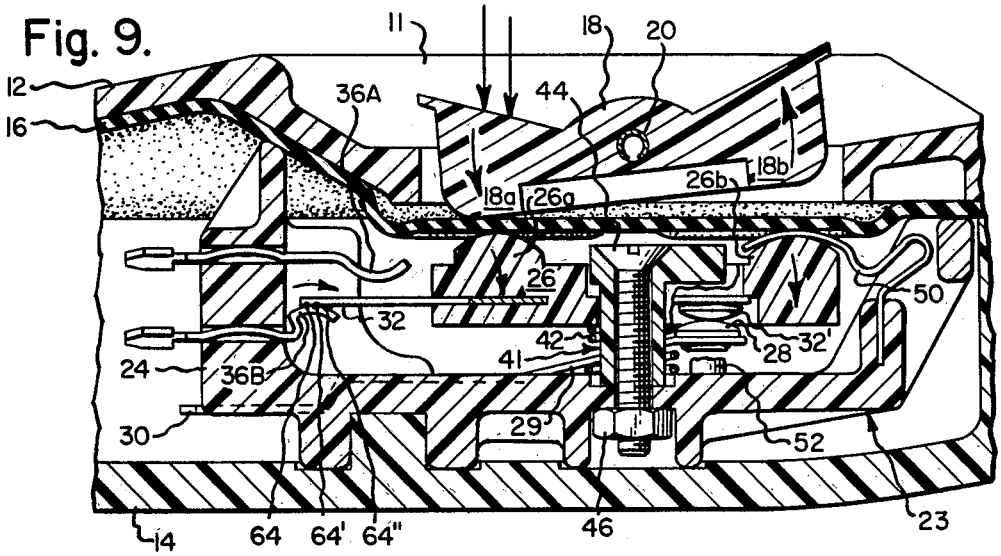
Figure 10:
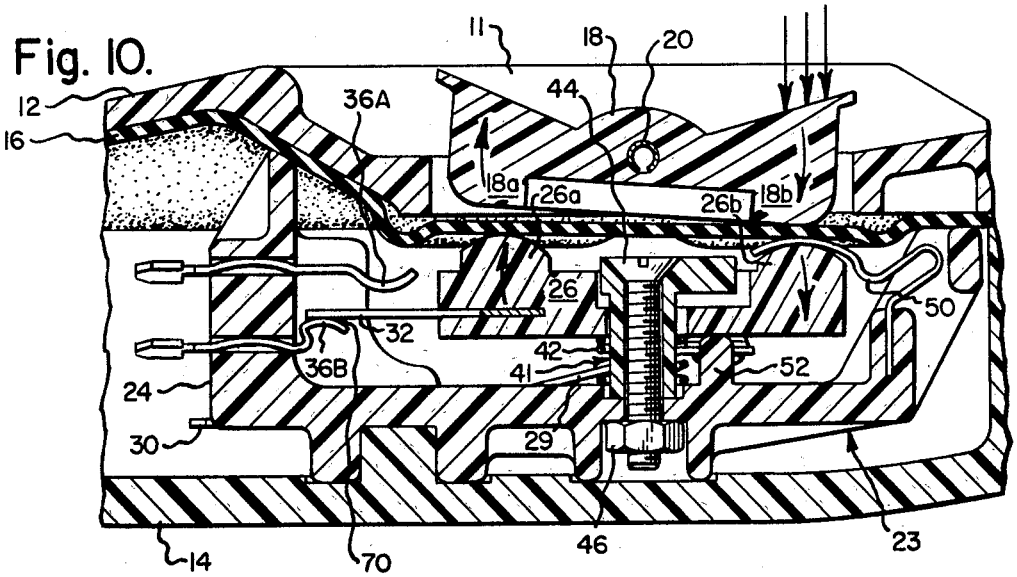

An additional feature of the switch assembly 23 is the provision of a non-resilient or stationary armature fulcrum 52 against which the armature 26 may be brought to bear with the exertion of an overload pressure on the right hand end of the rocker arm 18. Non-resilient armature fulcrum 52 may be formed on either longitudinal side of switch stand 41 as an upstanding post on base 24 or as a downwardly directed projection on the bottom surface of armature 26. The height or lateral dimension of the non-resilient armature fulcrum 52 is such that it lies slightly under the bottom surface of armature 26 when both power and passive contacts are made as shown in FIG. 9. The function of the armature fulcrum 52 is to provide a contact breaking rotation of the armature if the armature passive contact 32 and the base passive contact 36B were to be temporarily welded or otherwise held together. If such were the case, an overload pressure brought to bear on the right hand side of rocker arm 18 would be transmitted through the armature and would deflect the spring mounted power contact 28 toward the base. As shown in FIG. 10, continued overload pressure on the rocker arm 18 would bring the bottom surface of the armature 26 into contact with the upstanding fulcrum 52 and would create a clockwise torque which tends to separate the passive contacts 32 and 36B.

If passive contacts 32 and 36A were to experience a similar resistance to separation, an overload pressure brought to bear on the left hand end of rocker arm 18 would directly tend to separate the passive armature contact 32 from the passive base contact 36A.

Comparison of FIGS. 2, 6, 7, 8, 9 and 10 reveals the mode of operation of the switch of the present invention. In FIG. 2, the rest position is shown in which the armature is biased away from the base by spring 42 but whose lateral movement is limited by the retaining member 41. In this rest position, electrical contacts 32' and 28 are separated by a gap and electrical contact 32 is positioned midway between the base electrical contacts 36A and 36B.

FIG. 6 shows the switch assembly of the invention with a force being applied to the right hand end of the rocker arm 18. This force is transmitted through the gasket 16 to the armature 26 and produces a clockwise rotation of the armature 26 around a transverse axis 60 of the armature 26. Transverse axis 60 is located at a central position intermediate the first and second ends of the armature and hence intermediate the power and passive contacts of the armature. Since this transverse axis of rotation is located intermediate the power and passive contacts, pressure brought to bear on the upraised portion **26*b* of armature 26 causes the right hand end of armature 26 to move toward the base 24 and the left hand end of the armature 26 to move away from the base 24. The switch is designed so that this rotation brings the passive armature contacts 32 into electrical contact with passive base contacts 36A before the power contacts 32' and 28 touch one another. This effect may be accomplished by either positioning the passive and power contacts equidistant from this first rotational axis 60 but with the separation between the power contacts 32' and 28 being greater than the lateral separation between the passive contacts 32 and 36A; or it may be accomplished by having equal spacing between the two sets of contacts but with the passive armature contact 32 being positioned a further distance away from the first axis of rotation 60 than the power contact 32' so that the passive contact 32 travels a greater distance than the power contact 32' with a given amount of rotation of the armature 26**.

FIG. 6 shows that once the passive armature contact 32 touches the passive base contact 36A the axis of rotation of the armature shifts from a position intermediate the power and passive contacts to the point of contact 62 between passive contacts 32 and 36A. Since the downwardly facing surface of passive contact 36A is convex, it can be seen from FIG. 7 that continued clockwise rotation of the armature around the point of contact 62 causes the point of contact 62 to shift slightly to the left to successive points 62' and 62''. Consequently, the second transverse axis of rotation about which the armature rotates and which is positioned at the point of contact 62 between passive contact 32 and passive contact 36A also shifts slightly to the left. This feature of a shifting transverse axis of rotation produces a rolling motion which tends to clean the mutual surfaces of the two passive contact elements 32 and 36. In addition, as has been previously described above, the radius of curvature of the leaf spring 50 tends to pull the armature 26 longitudinally to the left due to the interaction between the curved leaf spring 50 and the curved surface of the raised portion **26*b* of the armature 26. As a result, both a sliding and rolling action is produced which creates a very effective self-cleaning action. This rolling and sliding action tends to wear a slight depression in the passive armature contact 32; a feature which substantially improves the reliablility of the establishment of the electrical contact and assists in the alignment in the passive contacts. Continued clockwise rotation of the armature about the transverse axis located at the point of contact 62 between passive contacts 32 and 36A eventually brings the power contacts 32' and 28 into touching relationship. When this occurs, electrical current is finally permitted to flow through the power contacts and the circuit is completed. In this manner, a staggered contact making sequence is established. This staggered contact making action prevents the passage of electrical current prior to the establishment of the electrical contact between passive elements 32 and 36** so that the passive contacts may be made of an inexpensive base metal alloy and so that a multiplicity of power carrying currents are passed simultaneously to a multiplicity of industrial components.

Gradual release of the pressure on the right hand side of the rocker arm 18 reverses the sequence. Hence, a counterclockwise rotation about the point of contact 62 opens the power contacts 32' and 28 prior to the opening of the passive contacts 32 and 36. Continued release of pressure causes the armature 26 to rotate around the transverse axes 62 which now shift to the right. Further release of the pressure on the right hand end of the armature 18 causes the axis of rotation to change from the point of contact 62 to the original central position 60 located intermediate the passive and power contacts. Rotation of the armature now proceeds until the armature has regained its rest or neutral position with the armature passive contact 32 intermediate the base passive contacts 36A and 36B.

Figure 8:
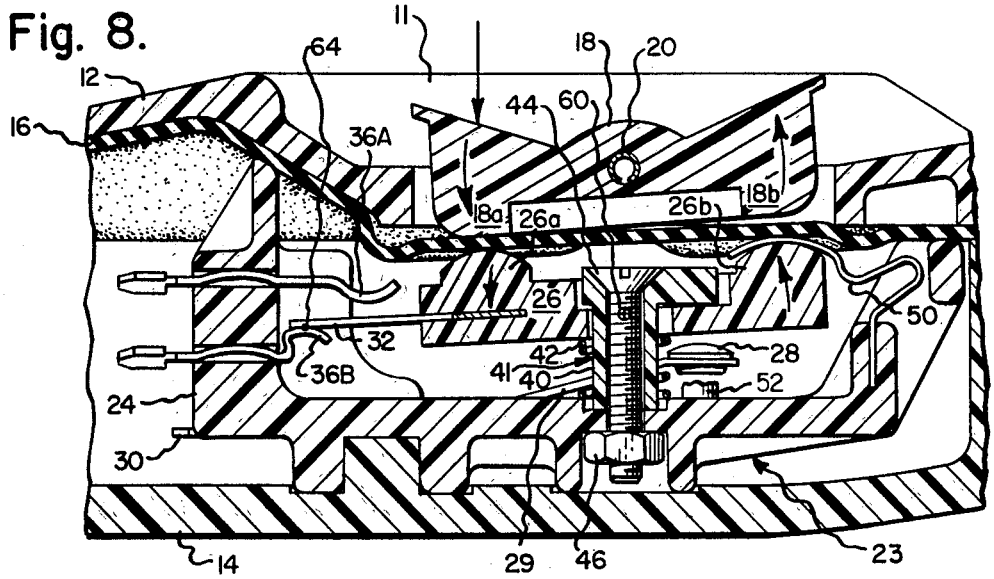

If pressure is applied to the left hand end of rocker arm 18 as shown in FIG. 8, the force is transmitted through gasket 16 to the raised portion **26*a* of the armature 26. This pressure tends to produce a counter-clockwise rotation about a transverse axis 60 positioned intermediate the passive contact 32 and the power contact 32'. Rotational movement of the armature 26 continues until the passive contact 32 makes electrical contact with the passive base contact 36B at which point the transverse axis of rotation shifts to the point of contact 64. Since the rotation of the armature has been counterclockwise with an axis of rotation positioned intermediate the two ends of the armature, the power contact 32' has tended to rotate away from the base power contact 28. Continued pressure now reverses the direction of rotation so that the armature now tends to rotate in a clockwise direction around a rightwardly shifting transverse axis of rotation 64 located at the rightwardly shifting point of contact 64, 64', 64'' between passive contact 32 and the upper convex curved surface of base passive contact 36B. This clockwise rotation eventually brings the armature power contact 32' and the base power contact 28 into electrical contact at which time the electrical current is permitted to pass through the completed circuit. Once again, reversal of the above described sequence causes the power contacts 28, 32' to break or open ahead of the passive contacts 32, 36B**, thereby assuring that the passive contacts are never permitted to open while they are passing an electrical current.

FIG. 10 shows a mode of operation of the switch which assures that the passive contacts 32 and 36B may be separated when desired regardless of the fact that they may have a tendency to stick together at point 70.

In this situation, an overload pressure applied to the right hand side of the rocker arm 18 will cause the armature to rotate in a clockwise direction around the point 70 until the base power contact 28 has been depressed to such a degree that the lower surface of the armature 26 is brought into contact with the upstanding post 52. At this point in time, further movement of the armature 26 is resisted by the sticking contact point 70 and by the obstruction caused by the post 52. Since the post 52 is a stationary, non-resilient obstruction, it acts as a non-resilient fulcrum about which the pressure applied to the armature 26 tends to cause the armature to rotate in a clockwise direction. As a result of the mechanical advantage created by the position of immovable or non-resilient fulcrum 52, a pressure of sufficient magnitude applied on the right hand end of rocker arm 18 will cause the contacts 32 and 36A to break apart.

As previously described, if the sticking action occurs between the passive contact 32 and the passive contact 36A, an extra pressure brought to bear on the left hand end of the rocker arm 18 will bring about their separation. In this manner, the switch of the present invention includes means by which the passive contact element 32 can positively be separated from either of the passive contact elements 36A or 36B.

It should be recognized that the above description of the inventive switch is a description of only one embodiment of the invention. Modifications of the above description can be made which do not depart from the scope of the invention. One such modification which readily comes to mind is that the passive contacts 36A and 36B may be planar rather than curved. In this case, the curvature may be incorporated in the passive contact element 32. Thus, any arrangement which causes contact 32 to have curved surfaces, such as an S shape, would be an acceptable variation of the invention. Furthermore, the above described resilient mounting means including switch stand 41 and biasing spring 42 is only one of the myriad of combinations which may be an acceptable construction for a resilient mounting means for the armature 26.

What is claimed is:

1. A pressure actuated switching apparatus, wherein said switching apparatus comprising:

a. a base having first and second electrical base contact means longitudinally spaced and electrically insulated from one another;

b. an armature having a longitudinal axis and having first and second electrical armature contacts longitudinally spaced from one another, said first and second electrical armature contacts being connected by an electrical conductor;

c. means acting between said base and said armature for resiliently mounting said armature laterally of said base with said first and second electrical armature contacts adjacent to said first and second electrical base contact means respectively, said mounting means permitting rotational movement of said armature about a plurality of axes transverse to the longitudinal axis of said armature, whereby a laterally directed force applied to either of said first or second ends of said armature tends to produce rotational movement of said armature about one of said plurality of axes, said axes including at least a first and a second transverse axis, said first transverse axis positioned intermediate said first and second electrical contacts of said armature, said second transverse axis positioned at the point of contact between said first armature contact and said first base contact means; whereby pressure applied at one end of said armature tends to produce a first rotation about said first axis until said first armature contact and said first base contact means are brought into electrical contact and whereby continued pressure on said armature tends to produce a second rotation about said second axis until said second armature contact and said second base contact means are brought into electrical contact with one another.

2. The switching apparatus as recited in claim 1 wherein said resilient mounting means further includes means for permitting limited longitudinal movement of said armature.

3. The switching apparatus as claimed in claim 2 further including means for producing limited longitudinal movement of said armature as said armature is rotated.

4. The switching apparatus as claimed in claim 1 wherein said first electrical base contact means includes a first contact A and a second contact B, contact A and contact B being laterally spaced from one another and wherein said first armature electrical contact is positioned between contact A and contact B so that said first armature electrical contact can be urged into electrical contact with one or the other of said contacts A and B.

5. The switching apparatus as claimed in claim 4 wherein said resilient mounting means includes means acting between said armature and said base for biasing said armature so that said first armature electrical contact is urged into contact with one or the other of contacts A and B.

6. The switching apparatus as claimed in claim 4 wherein said switching apparatus is a reversing switch and wherein said second base contact means is a power contact comprising a rare earth metal alloy and wherein contacts A and B are the reversing contacts: one provided for closing a circuit for movement in one direction and the other provided for closing a circuit for movement in the opposite direction.

7. The switching apparatus as claimed in claim 1 wherein said resilient mounting means includes a resiliently mounted armature fulcrum providing yielding lateral positioning and pivotal support intermediate said first and second ends of said armature.

8. The switching apparatus as claimed in claim 7 wherein said first electrical base contact means includes a first contact A and a second contact B, contact A and contact B being laterally spaced from one another and wherein said first armature electrical contact is positioned between contact A and contact B so that said first armature electrical contact can be urged into electrical contact with one or the other of said contacts A and B.

9. The switching apparatus as claimed in claim 1 wherein one of said first base contact means and said first armature contact includes a convex surface facing the other of said contacts and wherein said second transverse axis shifts along said convex surface as the point of electrical contact shifts along said convex surface with the rotation of said armature.

10. The switching apparatus of claim 9 wherein said resilient mounting means further permits limited longitudinal movement of said armature.

11. The switching apparatus of claim 10 wherein said first electrical base contact means includes a first contact A and a second contact B, contact A and contact B being laterally spaced from one another and wherein said first armature electrical contact is positioned between contact A and contact B so that said first armature electrical contact can be urged into electrical contact with one or the other of said contacts A and B.

12. The switching apparatus of claim 11 wherein said resilient mounting means includes a resiliently mounted armature fulcrum providing yielding lateral positioning and pivotal support intermediate said first and second electrical contacts of said armature.

13. The switching apparatus of claim 11 wherein said laterally spaced contacts A and B are longitudinally offset and have convex mutually facing surfaces.

14. The switching apparatus of claim 10 wherein said second base contact means is resiliently mounted on said base so that continued pressure exerted on said armature after said second armature contact and said second base contact means have achieved electrical contact, tends to deflect said second base contact means and thereby producing a wiping action between said second base contact means and said second armature contact.

15. The switching apparatus as claimed in claim 10 further including means for producing limited longitudinal movement of said armature as said armature is rotated.

16. The switching apparatus as claimed in claim 1 wherein said resilient mounting means includes resilient biasing means for urging said armature away from said base and means acting between said base and said armature for limiting movement of said armature away from said base, said resilient biasing means and said armature movement limiting means both acting on said armature intermediate said first and second armature contacts.

17. The switching apparatus as claimed in claim 1 further including means acting between said base and said armature for breaking contact between said first armature contact and said first base contact means.

18. The switching apparatus as claimed in claim 17 wherein said second base contact means is resiliently mounted on said base for movement toward said base.

19. The switching apparatus as claimed in claim 18 wherein said contact breaking means includes a non-resilient armature fulcrum adapted to act between said base and said armature and wherein said non-resilient armature fulcrum is positioned between said first and said second armature contacts whereby overload pressure on said armature toward said base tends to produce a rotation of said armature which separates said first armature contact and said first base contact means and further tends to displace said second base contact means toward said base.

20. A pressure actuated switching apparatus, wherein said switching apparatus comprising:

a. a base having input and output leads, said input and output leads terminating at their respective one end in power and passive contact means respectively, said power and passive contact means being longitudinally spaced from one another on said base, said passive contact means including first and second vertically spaced, longitudinally offset contacts having convex mutually facing surfaces, said power contact means being resiliently mounted on said base for vertical movement relative thereto and comprising a rare earth metal alloy;

b. an armature having an armature body and an electrical conductor having power contact means at one end and passive contact means longitudinally spaced therefrom, said passive contact means having upper and lower contact surfaces and said power contact means comprising a rare earth metal alloy;

c. means for resiliently mounting said armature adjacent to said base and for providing both rotational and limited longitudinal movement of said armature relative to said base, said means including a resilient spring for biasing said armature away from said base and a motion limiting means for limiting the movement of said armature away from said base, said spring and said motion limiting means permitting rotational movement of said armature about a plurality of axes transverse to the longitudinal axis of the armature, said spring acting as a resilient fulcrum for said armature; and d. a non-resilient fulcrum means acting between said base and said armature for breaking electrical contact between said base passive contact means and said armature passive contact means, said non-resilient fulcrum means being positioned intermediate said power and passive contact means, said non-resilient fulcrum means tending to induce passive contact breaking rotation of said armature when an overload pressure is applied to said armature at a position on one side of said non-resilient fulcrum away from said passive contact means.

21. The switching apparatus as claimed in claim 1 wherein said first electrical base contact means and said first electrical armature contact both include an equal plurality of electrical contacts, said plurality of first electrical armature contacts being resiliently mounted laterally adjacent to said equal plurality of first electrical base contacts.

22. The switching apparatus as claimed in claim 21 wherein said electrical conductor connecting said first electrical armature contacts to said second electrical armature contact is branched so that said second electrical armature contact is electrically connected to a multiplicity of said plurality of first electrical armature contacts.

23. The switching apparatus as claimed in claim 20 wherein said passive base contact means and said passive armature contact means both include an equal plurality of electrical contacts, said plurality of passive armature contacts being resiliently mounted laterally adjacent to said equal plurality of passive base contacts, and further wherein said electrical conductor connecting said power armature contact means and said plurality of passive armature contacts is branched so that said armature contact means is electrically connected to a multiplicity of said plurality of passive armature contact means.

* * * * *

UNITED STATES PATENT AND TRADEMARK OFFICE

CERTIFICATE OF CORRECTION

PATENT NO. : 4,105,882

DATED : August 8, 1978

INVENTOR(S) : Otmar M. Ulbing et al.

It is certified that error appears in the above-identified patent and that said Letters Patent are hereby corrected as shown below:

Delete columns 5 and 6 substitute attached therefor.

Signed and Sealed this

*Seventeenth* Day of *July 1979*

[SEAL]

*Attest:*

*Attesting Officer*

LUTRELLE F. PARKER

*Acting Commissioner of Patents and Trademarks* nected by an electrical conductor 33. Electrical armature contact 32, the armature passive contact, may consist of an inexpensive base metal alloy whereas electrical armature contact 32', the armature power contact, may consist of a rare earth metal alloy. The passive contact 32 which may be a multiplicity of passive contacts 32 are held in neutral positions adjacent to and intermediate the multiplicity of passive base contacts 36A and 36B. The armature power contact 32' is resiliently held in a neutral position adjacent to the base power contact 28. The resilient mounting means which positions the armature 26 adjacent to the base 24 (to be described hereinafter) permits the alternate movement of the armature passive contacts into touching relationship with either of the base passive contacts 36A or 36B. The resilient mounting means also permits the movement of the armature power contact 32' into touching relationship with the base power contact 28. Passive armature contact 32 is positioned midway between base contact 36A and 36B so that movement of the passive armature contact in either direction toward or away from the base 24 brings the armature contact 32 into electrical contact with either the base contact 36A or the base contact 36B.

FIG. 3 is a broken away top view of the armature 26 and illustrates the redundancy of the passive contacts and the power contacts. The electrical conductor 33 which connects the armature power contacts 32' with the passive contacts 32, may be divided into two or more branches as shown. Thus, the electrical conductor 33 originates at the armature power contact 32' and branches midway between the power contact 32' and the passive contact 32 into two adjacent branches. In this manner two of the adjacent passive contacts 32 as shown in FIG. 3 would carry the same power. If one of the industrial components to be serviced by this switch requires a power of a different voltage or current, this power may be brought into the remaining power contact 32' shown in phantom in FIG. 3 via the other base power contact 28. A straight electrical conductor 33 then connects the contact 32' (also shown in phantom) to the remaining passive contact 32. In this manner, one of the terminals 36A or 36B can be caused to be connected to a different power source.

Returning now to the embodiment shown in FIGS. 2 and 3, it can be seen that the top surface of armature 26 is provided with a rectangular recess 39. Extending downwardly from rectangular recess 39 is an ovular hole 38 communicating between the bottom surface of the armature and the rectangular recess 39. An L-shaped retainer or switch stand 41 fits into the rectangular recess 39 and penetrates through the ovular passage 38 with rectangular shoulder 48 occupying the rectangular recess 39 and with cylindrical shaft 40 passing through the ovular passage 38. The L-shaped retainer 41 is further provided with a cylindrical passage 56 therethrough coaxial with the axis of the shaft 40. The base 24 is in turn provided with a hole 54 which may be aligned with the cylindrical passage 56 of retainer 41. Screw 44 and nut 46 are shown holding the L-shaped retainer 41 firmly to the base 24. A spring 42 is concentrically positioned exterior to the shaft 40 for the purpose of resiliently pressing the armature 26 away from the base 24. Spring 42 biases the armature 26 laterally away from the base but shoulder 48 on the L-shaped retainer 41 limits the lateral movement of the armature 26 away from the base 24.

As can be seen from an examination of FIG. 2 and FIG. 6, the rectangular recess 39 has a longitudinal length longer than the rectangular shoulder 48. The ovular passage 38 is oriented with its major axis aligned with the longitudinal axis of armature 26. These two features, ie, the size of the rectangular recess 39 and the orientation of the ovular passage 38, permit the armature 26 to be rotated about an axis or axes transverse to the longitudinal axis of the switch assembly 23. Furthermore, the relative sizes of these elements permits a limited longitudinal movement of the armature but does not permit any appreciable degree of a transverse movement. As can further be seen from FIG. 2, the raised portion **26*b* has a curved surface. Immediately overlying this curved surface is a leaf spring 50 which is captured in the second end of the base 24 and which itself has a curvature. The spring 50 operates to somewhat increase the resistance against actuation of the rocker in the "down" direction; thereby equalizing the pressures required to shift the rocker in either direction. This gives the operator a uniform "feel" of the switch mechanism such as when operating the hoist in either direction. Also note, the degree of curvature of the portion of the leaf spring 50 which overlies the raised portion of 26*b* of the armature 26 is less than the degree of curvature of the upwardly facing surface of the raised portion 26*b*. The difference in curvatures between the leaf spring 50 and the raised portion 26*b* of the armature 26 assists in causing the armature 26 to undergo a limited longitudianl movement when the leaf spring 50 is depressed by pressure exerted on the rocker arm 18. Thus, when the leaf spring 50 is forced into engagement with the raised portion 26*b*, the interaction of the surfaces tends to draw the armature 26 to the right. Alternatively, another possible arrangement which would produce the longitudinal movement of the armature 26 would be if the downwardly facing surfaces of rocker arm portions 18*a* and 18*b* were angled such that the pressure transmitted by the rocker arm 18 was applied to the armature 26** in a direction having an angle with the vertical.

An additional feature of the switch assembly 23 is the provision of a non-resilient or stationary armature fulcrum 52 against which the armature 26 may be brought to bear with the exertion of an overload pressure on the right hand end of the rocker arm 18. Non-resilient armature fulcrum 52 may be formed on either longitudinal side of switch stand 41 as an upstanding post on base 24 or as a downwardly directed projection on the bottom surface of armature 26. The height or lateral dimension of the non-resilient armature fulcrum 52 is such that it lies slightly under the bottom surface of armature 26 when both power and passive contacts are made as shown in FIG. 9. The function of the armature fulcrum 52 is to provide a contact breaking rotation of the armature if the armature passive contact 32 and the base passive contact 36B were to be temporarily welded or otherwise held together. If such were the case, an overload pressure brought to bear on the right hand side of rocker arm 18 would be transmitted through the armature and would deflect the spring mounted power contact 28 toward the base. As shown in FIG. 10, continued overload pressure on the rocker arm 18 would bring the bottom surface of the armature 26 into contact with the upstanding fulcrum 52 and would create a clockwise torque which tends to separate the passive contacts 32 and 36B.